United States Patent [19]

Yenni

[11] 4,082,870

[45] Apr. 4, 1978

[54] METHOD FOR COATING NONSYMMETRICAL OBJECTS

[75] Inventor: Donald McKelvie Yenni, Indianapolis, Ind.

[73] Assignee: Union Carbide Corporation, New York, N.Y.

[21] Appl. No.: 645,040

[22] Filed: Dec. 29, 1975

[51] Int. Cl.[2] ..... B05D 1/02; B05D 1/08

[52] U.S. Cl. ..... 427/425; 427/423

[58] Field of Search ..... 427/425, 423; 118/319, 118/320

[56] References Cited

U.S. PATENT DOCUMENTS 3,859,118 1/1975 Snyder ..... 427/425 X

*Primary Examiner*—James R. Hoffman

*Attorney, Agent, or Firm*—Dominic J. Terminello

[57] ABSTRACT

Method and apparatus for coating irregular and/or small regular parts such as for example, turbine blades. Apparatus features a workpiece spindle carrying member mounted on a base, a plurality of workpiece spindles mounted on the carrying member, means for rotating the carrying member and other means for rotating the workpiece spindles, means correlating the speed and direction of rotation of the carrying member and the workpiece spindles.

Method includes the steps of depositing coating material on the workpiece as the parts translate and rotate past a device for depositing coating material.

6 Claims, 4 Drawing Figures

METHOD FOR COATING NONSYMMETRICAL OBJECTS

This invention relates to method and apparatus for coating parts. More particularly, this invention relates to coating parts of irregular shapes, such as turbine blades or parts of regular shape which are considered to be small for coating with presently available apparatus and methods.

It is well known that in order to achieve coatings of uniform thickness and quality, four parameters must be controlled. The parameters that should be constant are 1) work surface speed of the part past the device for depositing coating material; 2) distance between the work surface and the coating device (standoff); 3) angle (preferably 90 degrees) between the surface to be coated and the spray device; 4) the exposure time to the spray device for each element of the work surface. These parameters are easily controlled when the part to be coated is a round cylindrical part of one inch diameter or larger. In such case, the part is rotated about its axis at constant speed. A spray device is positioned so that the spray strikes the surface at about a 90 degree angle and the spray device is moved at a constant speed in a direction parallel to the axis of rotation.

However, when the part to be coated is a complex shape such as an airfoil, different surface elements pass through the coating depositing effluent at different speeds. To illustrate this point, reference is made to FIGS. 1*a* and 1*b* which are schematic drawings of an airfoil being rotated relative to a spraying device.

Figure 1A:
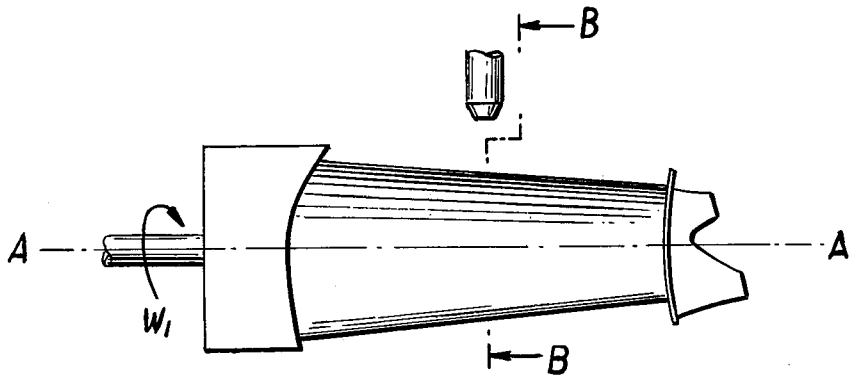
Figure 1B:
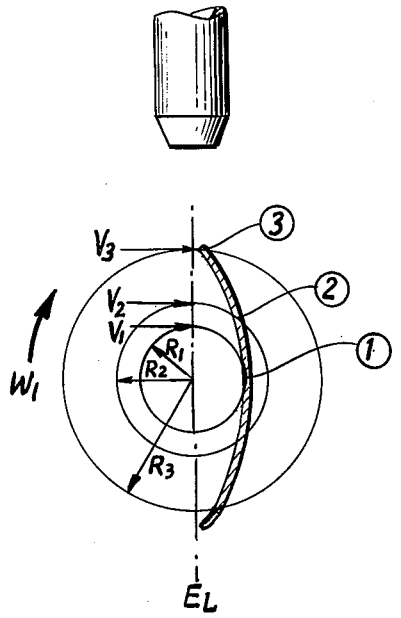

FIG. 1*b* is a view taken along line B—B in FIG. 1*a*. As the part rotates about axis A at some angular velocity $W_1$, it can be seen that as points (1), (2) and (3) move through the effluent, represented by line $E_L$, each has a different velocity as described by the equation $V_n = R_nW_1$. As the radius $R_n$ increases the velocity V increases, thus the coating thickness decreases.

Another approach to the application of spray coatings on nonsymmetrical objects is to rapidly move the torch along a path essentially parallel to the AA axis. By the use of cams, levers, and other mechanical linkages, one can maintain constant standoff as the blade or vane is slowly indexed. The rapid movement of the torch along a path essentially parallel to the axis of the blade provides the relative surface movement. While this process meets the coating requirements of constant standoff and constant surface speed, the equipment to provide such movement is very expensive to construct and unreliable in operation. The costs of providing high acceleration rates required to move the torch back and forth at constant velocity makes this equipment expensive. In addition, the vibration induced by the rapid reversal at the limits of the machanism movement results in poor component life of the machine elements.

The present invention is predicated on the discovery that when a complex part such as an airfoil is rotated about an axis essentially through or near the part and this axis is in turn rotated about a second axis parallel to the first in a prescribed relationship, high quality coatings can be obtained. It is not essential that the part rotate about an axis in the part. For example, in the case of an airfoil shape, if a circle were drawn around the airfoil cross-section, the preferred axis of rotation would be contained within the circle.

In one aspect of the invention there is provided a method for coating parts (irregular or small regular parts) wherein the part is rotated about its own long axis. The rotating long axis is then rotated about a second axis spaced from and parallel to the long axis. The speed and rotation of the long axis and the second axis are correlated so that the rotational speed of the part relative to ground is usually less than 100 R.P.M.s.

A spray device is provided for depositing a coating material on the part as its moves past the device. The movement of the part past the spray device is continued until the desired coating is achieved.

In another aspect of the invention there is provided a machine having a base upon which a workpiece spindle carrying member is rotatably mounted. A plurality of workpiece spindles are mounted for planetary rotation on the rotatably mounted workpiece spindle carying member. Means are provided in operatively associated relationship with the workpiece spindle carrrying member and each of the workpiece spindles for rotating such members. The speed and direction of rotation of the workpiece carrying member and the workpiece spindles are correlated with each other.

Figure 2:
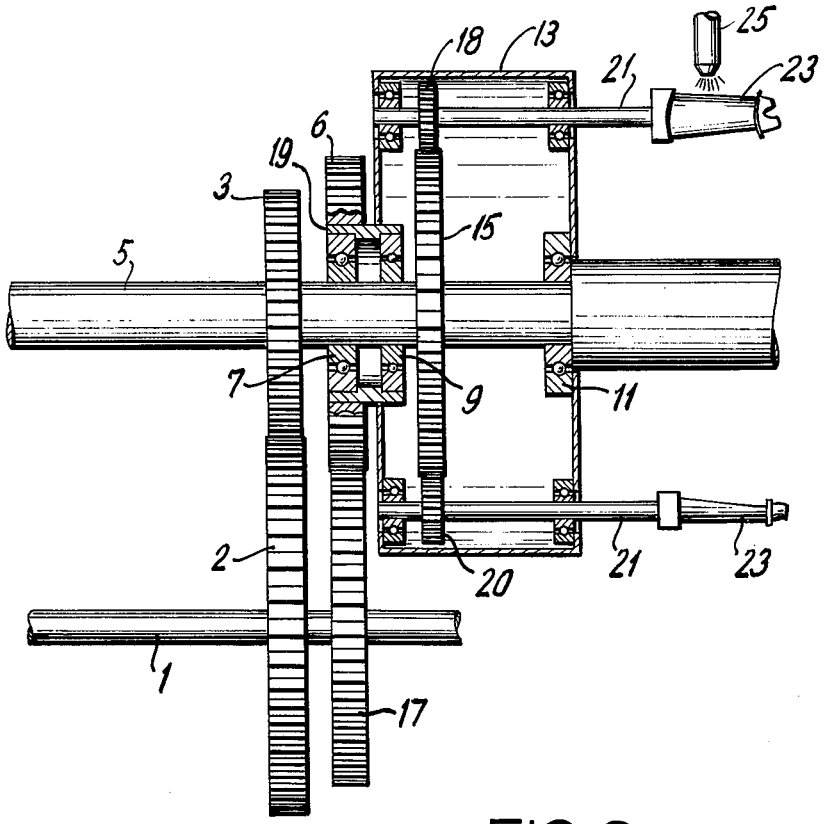
Figure 2B:
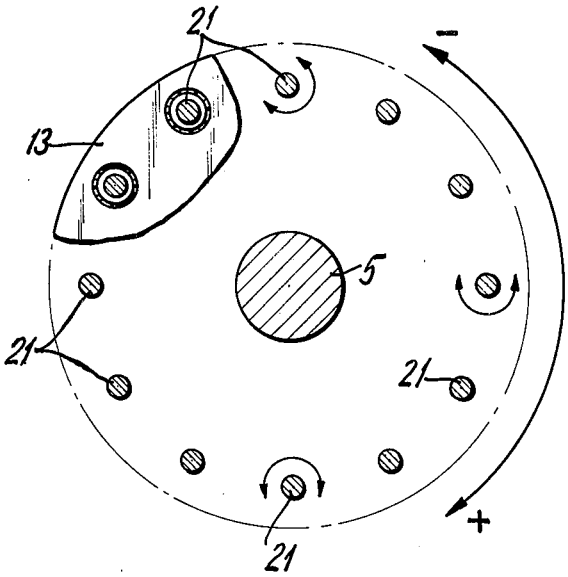

FIG. 1*a* is a schematic drawing of an airfoil positioned relative to a spray device;

FIG. 1*b* is a view taken along line B—B in FIG. 1*a* and shows the angular velocity at various points along the airfoil;

FIG. 2 is a side elevation view of a schematic drawing of typical apparatus for carrying out the invention; and FIG. 2*b* is a side elevation view partially cut away of the apparatus shown in FIG. 2.

Having described the invention in a general way, reference will now be made to FIG. 2 which is side elevation schematic drawing of typical apparatus for carrying out the invention. In FIG. 2 the machine comprises a shaft 1 which is driven by a motor and forms part of the machine base. Shaft 1 drives pinion gear 2 which meshes with and drives main gear 3. Gear 3 is mounted on and drives main machine shaft 5. Main shaft 5 is mounted through a set of bearings 7, 9 and 11 to the workpiece carrying member or cage 13. The main shaft 5 drives the sun gear 15. Shaft 1 also drives the cage pinion gear 17 which in turn drives gear 6. Gear 6 has a bushing 19 upon which is mounted the cage 13. Sun gear 15 drives the planetary gears 18 and 20, shown in FIG. 2, and as many other planetary gears as there are workpiece spindles 21. In FIG. 2*b* which is a side sectional view of the apparatus shown in FIG. 2, there are shown 12 workpiece spindles. Parts to be coated, such as turbine vanes 23, are mounted on the workpiece spindles 21. A coating device 25 is mounted in proximity to the parts to be coated so that as the parts translate and rotate past the torch, the desired coating is achieved. Rotation of the planetary gears 18 and 20 etc. is the net result of the angular velocity of the sun gear 15 and the angular velocity of cage 13 caused by the gear 6. Thus if the angular velocity of the workpiece spindles with respect to the cage 13 is equal in magnitude to the angular velocity of cage 13 and opposite in direction, the "net" rotation is essentially zero. While meshed gear systems are illustrated in FIG. 2, other gearing means, such as toothed belt drive systems or chain drive systems, can be used. Because of the low "net" angular velocity, it is possible to construct simple inexpensive torch manipulation equipment to meet the constant standoff and angle requirements. In addition, the exposure time to the plating device for each of the workpiece elements is approximately constant.

Because of the low angular velocity of the method, it can be used to advantage with small diameter parts (less than one inch diameter). Some coatings require a surface speed of 1000 ft. per minute minimum for maintaining proper metallurgical characteristics. To coat a 1/16 inch diameter part with this velocity requires a rotational speed of approximately 60,000 rpm. The equipment required to provide this velocity is expensive to construct and difficult to maintain due to the coating environment. Moreover, it is very difficult to control the temperature of the part. However, if the parts are fixed to spindles which rotate about an axis of support and the spindles are spaced about a 5-inch diameter circle, then the required rotation rate of the central axis is only approximately 760 rpm and part temperature is easily controlled.

Having described the invention with respect to one embodiment thereof, it should be understood that modification can be made to the elements or to the arrangement thereof without departing from the spirit and scope of the invention. For example, by changing a set of gears, the system can be changed to a synchronous relationship in which the workpiece is rotated exactly one-half turn for each complete rotation of the cage. This latter arrangement is well suited to plate the opposite sides of a flat object on a continuous basis. Other "phased" relationships are possible if necessary or desirable.

What is claimed is:

1. A method for coating objects comprising
(a) rotating said object about a longitudinal axis;
(b) rotating said longitudinal axis about a second axis spaced from and parallel to said longitudinal axis so as to provide translation and rotation of said objects;
(c) correlating the speed and direction of rotation of said longitudinal axis and said second axis;
(d) providing a spray coating device in proximity to said objects for depositing coating material thereon;
(e) depositing coating material on said object as it moves past said spray coating device;
(f) continuing the translation and rotation of said object past said spray coating device until the desired coating is achieved.

2. A method according to claim 1 wherein said objects are turbine vanes.

3. A method according to claim 1 wherein said objects are turbine blades.

4. A method according to claim 1 wherein said objects are small regular objects having circular corss-sections of up to one inch in diameter.

5. A method according to claim 1 wherein said objects are irregular shapes.

6. A method according to claim 1 wherein said objects are regular objects having noncircular cross section.

* * * * *